US005907294A

United States Patent [19]

Welte et al.

[11] Patent Number: 5,907,294

[45] Date of Patent: May 25, 1999

[54] PROCESS FOR DETECTING SOURCES OF DANGER

[75] Inventors: Elmar Welte, Alfeld; Christoph Bolay, Bretzfeld, both of Germany

[73] Assignee: EE-Signals GmbH & Co. KG, Alfeld, Germany

[21] Appl. No.: 08/793,184

[22] PCT Filed: Aug. 9, 1995

[86] PCT No.: PCT/EP95/03163

§ 371 Date: Apr. 1, 1997

§ 102(e) Date: Apr. 1, 1997

[87] PCT Pub. No.: WO96/05095

PCT Pub. Date: Feb. 22, 1996

[30] Foreign Application Priority Data

Aug. 13, 1994 [DE] Germany ..... 44 287 84

[51] Int. Cl.[6] ..... G08G 1/16; B61L 25/02

[52] U.S. Cl. ..... 340/903; 340/901; 340/908; 246/124

[58] Field of Search ..... 340/901, 902, 340/903, 908, 908.1, 941, 425.5, 426; 246/167 A, 166, 122 R, 124

[56] References Cited

U.S. PATENT DOCUMENTS

| | | | |
|---|---|---|---|
| 3,838,271 | 9/1974 | Ackard et al. | 246/125 |
| 3,991,485 | 11/1976 | Golenski | 340/993 |
| 4,491,290 | 1/1985 | Douglas | 246/169 |
| 4,674,067 | 6/1987 | Zemanek, Jr. | 367/25 |
| 5,265,831 | 11/1993 | Muller | 246/124 |

FOREIGN PATENT DOCUMENTS

| | | | |
|---|---|---|---|
| 0 024 978 | 3/1981 | European Pat. Off. . | |
| 93 14 495 | 1/1994 | Germany . | |
| WO 91/10584 | 7/1991 | WIPO . | |
| 9421504 | 9/1994 | WIPO | 340/901 |
| WO 9 94/21504 | 9/1994 | WIPO . | |

*Primary Examiner*—Jeffery A. Hofsass
*Assistant Examiner*—Van T. Trieu
*Attorney, Agent, or Firm*—Scully, Scott, Murphy & Presser

[57] ABSTRACT

Proposed is a new early warning system for warning persons in a track building site of approaching trains, which receives the danger source consisting of a train by sensors and transmits the signals to alarm installations (8, 9, 10). The alarm installations consist of a siren (8) and optical warning device (10) for the transmission of flashing lights and of a vibrator (9) which can be carried at the body of a person to be warned. The sum of these three alarm installations in connection with suitable sensors (11) and an evaluating unit or central unit form the nucleus of the system.

25 Claims, 4 Drawing Sheets

PROCESS FOR DETECTING SOURCES OF DANGER

BACKGROUND OF THE INVENTION

1. Field of the Invention

The invention relates to a method for the determination of sources of danger, primarily such in the region of railways, and especially an early warning system for the detection of approaching railway vehicles.

The persons which are concerned with the carrying out of work and are present in the zone of the tracks for railway vehicles, are permanently exposed to the danger of accidents through the railway vehicles. In addition to human neglect or error, there is also encountered an important ground for accidents through the lack of attention to an acoustic and/or optical alarm signal which would alert the persons to leave the danger zone.

The personnel which are present in the track zone; for example, such as track workers, are subjected to considerable stresses caused through heavy physical work, noise, dust and high or, respectively, low temperatures. In addition thereto, encountered as a further difficulty for the personnel, is the fact that the modern high speed trains approach extremely rapidly and relatively silently towards a track construction site. The safety posts which must trigger a siren as soon as they have visual contact with an approaching train, at least with respect to construction sites at express traffic lines, are unable to provide an adequate preliminary warning period for the endangered personnel. A further problem resides in the loads on the safety posts through inadequate or low demands. The lengthier inactivity in the pauses between trains reduces the alertness of the security posts to such an extent that they will frequently detect an approaching train only belatedly, and as a result the siren is actuated too late.

Safety posts can be integrated into the official railway train reporting chain, and connected by long distance telephone with the applicable railway service supervisor. Notwithstanding the foregoing, a track building site, due to the necessary deviation of the normally introduced operating modalities, presents a positively increased risk in the operation of the railroad. The cause for a few accidents in the past were, for example, errors in reporting the transmission of the reporting of trains, independent deviations of operating personnel on railway vehicles from the content of an already transmitted train report, or timewise earlier then for the applicable railway service, a reported receipt of the building activities in the track zone.

Already in the region of the German Railway alone there are operated each day approximately 3,000 building sites for track construction and track repair or maintenance work. Notwithstanding a massive utilization of research means it has heretofore been impossible to develop and to install an optimized safety system for endangered personnel in the zone of the rails.

2. Discussion of the Prior Art

From German Petty Patent DE 9314495 U1 there has become known an electronic arrangement for the warning of track construction workers of approaching trains, in which a vibration receiver detects the vibrations in the rails upon the passing thereover by a train, and transmits this to a signal evaluating arrangement. Computed in the evaluating arrangement are the different train parameters and upon cognizance of the source of danger, there are activated the different warning installations. The computation of the train parameters in the evaluating arrangement is carried out in dependence upon the signal transmission time between a first and a second vibration receiver.

German Patent Specification DE 4214271 A1 discloses a method for the determination of sources of danger and for the emission of acoustic and/or optical warning signals for persons which are present in the danger zone. The source of danger; for example, a train, is detected by means of acoustic body sound sensors. The signals which are emitted from these body sound-sensors are amplified and, thereafter, transmitted to an alarm installation for the emission of warning signals.

SUMMARY OF THE INVENTION

Commencing from the above-mentioned state of the technology, it is an object of the invention to provide a method for the determination of sources of danger and for the emitting of warning signals of the above-mentioned type, which can be simply handled, which is independently-operably located outside of the official railway safety information chain, and which significantly increases the safety of a rail or track construction site also with regard to high speed trains by means of technologically simple means.

The inventively proposed early warning system supplements the currently present signal posts, and assists in precluding the possible causes of accidents from requirements which are a result of the inadequate demands by the signal posts. This system, in accordance with the degrees of importance which are present with regard to the operation of the railroad, and the applicable safety regulations, can safely replace the signal posts. The inventive system, in an advantageous manner, can be utilized on open track sections and/or in the area of the railway station.

The safety system is based on the evaluation of sensor signals, especially of body sound vibrations in the region of the rails, and on a wirelessly transmitted alarm which is supported on applicable evaluating results, which enables the personnel of a building or repair site to leave the area of the rails. The personnel are warned through the conventional siren, as well as by means of an alarm apparatus which is carried on the body. These alarm devices on the body warn the person in an optical manner through flashing lights and/or in an acoustic manner, and additionally through the emission of an intensive vibration on a sensitive body region, for example; in the seat or in the hip region.

The advantage of the pulse-maintaining body sound signal, which is described in the dependent claims, is based on that a second completely different body sound signal which is emitted by the body sound of the traveling train is introduced into the rail, which is directly triggered from the traveling train or, respectively, the railway vehicle.

The solution, which is represented in the embodiment of the invention, of the pneumatic over traveling contact consists of an elastically deformable body, which possesses chambers with a constantly equal static pressure. When a wheel rim of a vehicle wheel runs onto the body, the volume of the chambers is then rapidly reduced, whereby the pressure in the chambers rises above the static pressure. This increased pressure is converted by means of sensors. Through the arrangement of two separate, successively located chambers with separate pressure sensors, for example, PE-converters, there can be detected the direction of the over traveling railway vehicle through the successive sequence of the sensor actuation.

The sensor element or the sensor elements are preferably located within a housing which, by means of built-in magnets can be fastened on a side surface of the railway. The advantage of this type of fastening lies in that it is not necessary to provide any specialized tool for the attachment of the sensors. In order to ensure a secure fastening of the sensors, which also prevents an intentionally desired removal of the sensors for purpose of manipulation, the damaging of the article or a removal which is unlawful, there can be selected other fastening means, which can only be handled by means of special tools. The housing possesses a system switch for the actuation and for the switching-off of the sensors. In order, in this instance, to also preclude any external manipulations, there can be utilized an internally located electronic switch which can be activated and deactivated from the outside.

Due to the broad frequency spectrum which is applicable to body sound measurements on rails, there are preferred one or more sensors or groups of sensors, which can cover a range of f=20 Hz up to 20 kHz. As particularly advantageous, inasmuch as it is good forwardly transmissive, there have been proven to be body sound vibrations within the range of about 12.5 kHc.

Alternatively to the pick-up of body sound vibrations, there can also be utilized optical sensors; for example, infrared sensors, or other electronic sensors. With regard to these sensors, there are naturally required other evaluating criteria. Such criteria can be purely light barrier techniques. However, they can also be picture-processing techniques, which signify that the sensor detects a marked portion of a train, compares this through an image; for example, in the image computer, and upon recognition of the train triggers an alarm signal.

Inasmuch as by means of the threshold distance there is defined a resonance of $\lambda/2$, the measurement receiver for the body sound vibrations, if at all possible, should be precisely located between two thresholds. Between the two thresholds, due to the yieldability of the railroad track, there should be determined the greatest rapidity of transversal vibrations.

The entire safety system must be rapidly activatable, without any placement of cables, and stand available in readiness for operation. The alarm apparatuses may not represent any additional loads on the working personnel or signal posts. Through the early warning system, on the one hand, there may not be disrupted any electrical fields, signal installations or other installations. On the other hand, the early warning system should itself not be disrupted by such electrical fields.

Further advantageous details of the inventive early warning system are ascertainable from the following description of drawings.

BRIEF DESCRIPTION OF THE DRAWINGS

In the drawings there is illustrated an example of the invention. Shown are.

DETAILED DESCRIPTION OF PREFERRED EMBODIMENTS

Figure 1:
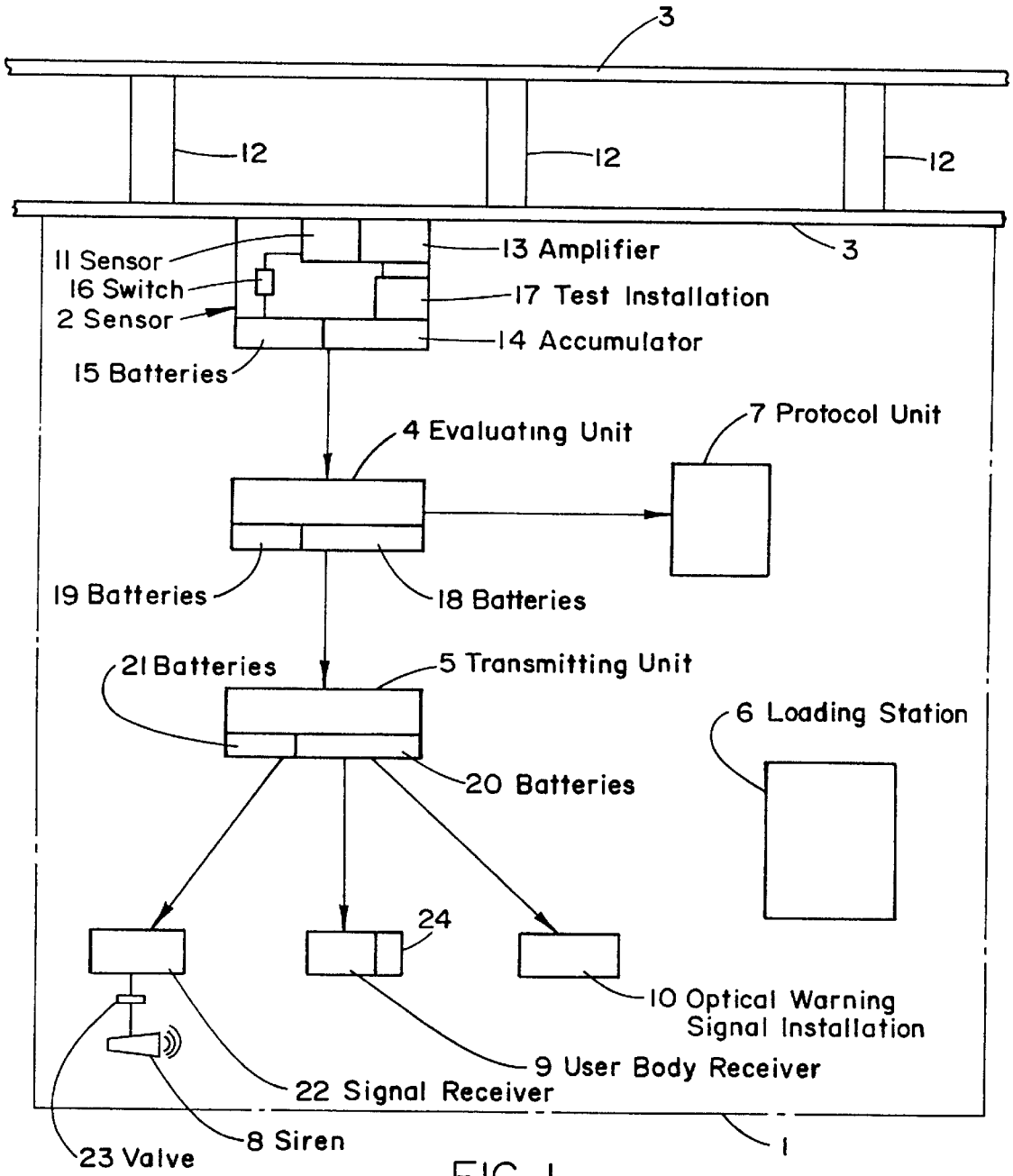
FIG. 1 is the safety system shown by in a block circuit diagram.
Figure 2:
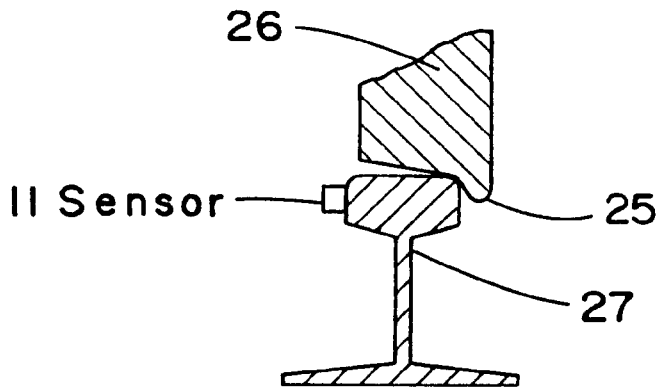
FIG. 2 is a rail with a body sound sensor shown in cross-section.
Figure 3:
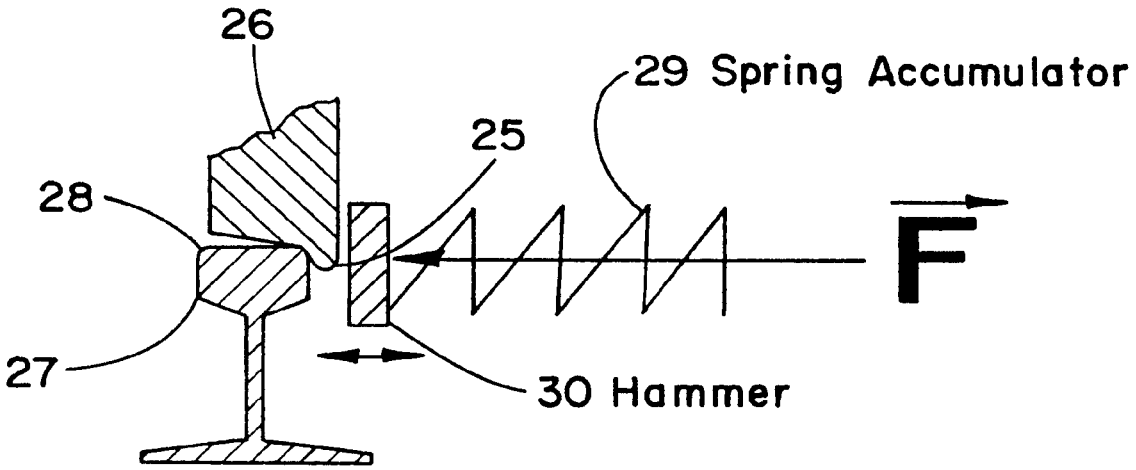
FIG. 3 illustrates a rail with another body sound sensor shown in cross-section.

FIG. 1 schematically illustrates the safety system of the inventive type, which can be installed in readiness for operation on the rail installations.

The safety system 1 as an early warning system for the detecting of approaching railway vehicles consists of a sensor unit 2, which is fastened at a safety distance of about 3 kilometers from a building or repair site on the tracks 3, an evaluating unit 4 for the evaluation of measurement signals transmitted from the sensor unit 2, a transmitting unit 5 for the further transmission of the respective warning signal to the different receiving units, and a loading station 6 which is concurrently employed as a storing locale for the system elements.

Instead of the mentioned single sensor unit 2, there can also be employed a plurality of sensor units or groups of sensors, which can be interlinked with each other.

It is also inherently understood that it is possible to have other distances or, respectively, safety spacings from the receiving sensors to the alarm installations.

The receiving units are located on the protocol unit 7, on the compressed air bottle (siren) 8, with the laborers or, for example, personnel in the track zone on their body 9, as well as eventually also on an optical warning signal installation 10. The signal transmission between the individual elements of the early warning system 1 is preferably effected in a wireless manner.

The sensor unit 2 is mobile and can be installed, for example, by means of magnets on the rails 3, or for a more secure fastening, by means of special work tools. The sensor unit possesses a sensor 11 which, in the example, receives the body sound of the rails 3 in three coordinate directions. In this instance, the sensor unit 2 should be fastened precisely between two thresholds 12, inasmuch as here there are encountered the highest values of the transversal vibrations. Due to the broad frequency spectrum which can be received for body sound measurements in rails, there must be utilized sensors 11 which from the standpoint of measurement technology can cover the range of f=20 Hz up to 20 kHz. Additionally, these sensors 11 should be particularly sensitive to measurements at a frequency of f=12.5 kHz, inasmuch as the body sound vibrations at this frequency are especially good forwardly transmitted in the rail. Alternatively, there can; for example; also be used an infrared or laser signal as the sensor. Between two alarms there does not basically exist any dead period for the sensor 11. An amplifier unit 13 generates amplified signals for transmission of the measured signals to the evaluating unit 4.

In addition to the travel noise which is generated in the rail by a railway vehicle (train), ahead of a construction site there can also be mounted an arrangement which is actuated by the wheel flanges 25 of the wheels 26 of the train traveling thereover, and which introduces into the rail an impulse containing body sound signal which is dependent upon the speed of travel of the train. As a result, available for body sound evaluation are two different signals, namely, a continued body sound level which is caused by the travel of the train within the rail 27, which is detected by the sensors 11, and the active impulse-containing body sound excitation.

The entry of the impulse-containing body sound is preferably effected in the track head 28, whereby besides the track upper surface there can be utilized also the other sides of the track 27. The mechanism which is triggered through the traveling thereover of the flange 25 of the wheel 26 can transmit energy through mechanical, hydraulic or pneumatic means energy to the rails 27. This energy can be stored in a spring accumulator 29 or another suitable installation. Through the stored energy there can be released, for example, a hammer 30 which strikes with a force F against the rail 27 and thereby introduces the body sound into the rail 27. The actuation of the striking object can be triggered mechanically, electrically or also pneumatically.

In particular, for the triggering of warning installations, which signal the presence of a train approaching a track construction site, there are required flexible sensors which in running operation, are fully monitorable, and which without any doubt can recognize a train traveling over the sensor. With regard to the state of the technology, there may here be encountered different rail or track switch contacts and axle counters, which partially require an appreciable technical demand upon installation into a rail or, respectively, into a track, and as a result cannot be sensibly economically employed for flexible track construction sites. Furthermore, the demands of train operation cannot be fulfilled without any gap and any sensors are not demountable without the assistance of work tools. Finally, a constant monitoring of the preparedness for operation is not possible, as a result of which such switch contacts are not safe for the signal technology.

Figure 4:
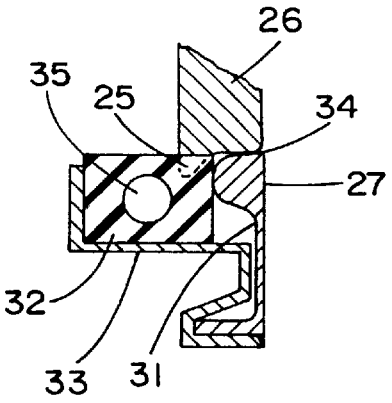
FIG. 4 illustrates a rail with a pressure sensor shown in cross-section.
Figure 5:
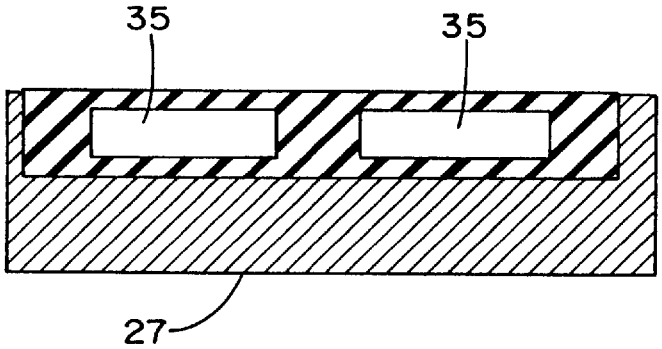
FIG. 5 illustrates the pressure sensor of FIG. 4 shown in longitudinal section.

The solution pursuant to FIGS. 4 and 5 consists of a pneumatic/electrical system actuated by the flange 25 of the wheel 26 of the railway vehicle traveling thereover. On the inside 31 of the track 27 of a rail there is provided an elastically deformable member 32, for example, of a rubber-type rectangular material, fastened by means of a retainer 33 such that it closes with the upper edge or, respectively, the traveling edge 34 of the rail. The member is selected of such a width that a passing wheel flange 25 will then also run on the member 32 when the railway vehicle is pressed by means of centrifugal force against the oppositely located rail of the track, and the wheel flange 25 on the side of the sensor 32 (11) will not contact against the rail head.

The necessary length of the member parallel to the longitudinal axis of the rail is determined by two mutually separated, successively located chambers 35. In both chambers 35 there is ensured a steady static pressure, which is concurrently monitored. When the chamber pressure drops below the static pressure, there must be assumed a damaging of the system. Necessarily, there is then emitted a disturbance signal.

When the flange 25 travels on the member 32, then the volume of the chambers 35 is rapidly reduced. As a result, the pressure in these chambers 35 rises above the static pressure. This significantly higher pressure is then converted by means of sensors, preferably, PE converters, so that there is clearly determined the traveling thereover of a train. The sensor is not utilized as an axle counter; however, it confirms every wheel traveling over the sensor, which signifies a redundancy in the signal triggering. The system can be so designed that only after an initial triggering of a signal within a defined period of time through the subsequently following wheels (axles) is there ensured that there will not be effected a second triggering.

The preferably utilized PE-converters close an electrical switch through the encountered pressure shock at defined conditions.

Through the arrangement of two separate chambers 35 which are located in series, both of which are connected to separate pressure sensors, there can be detected the direction of the train traveling thereover through the series sequence of the sensor actuation.

The hardness of the rubber-type member 32 can be designed such that a person cannot trigger the sensor without the assistance of work tools.

Figure 6:
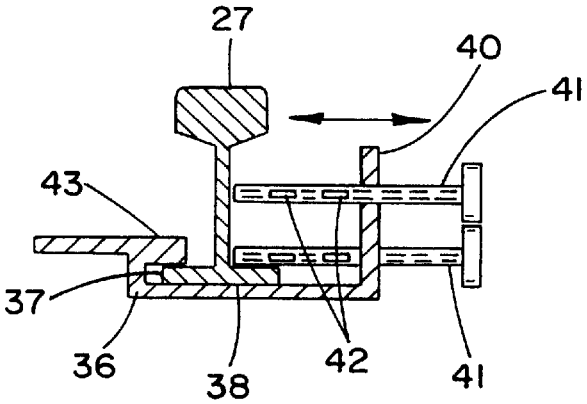
FIG. 6 illustrates the rail with a sensor carrier shown in cross-section.
Figure 7:
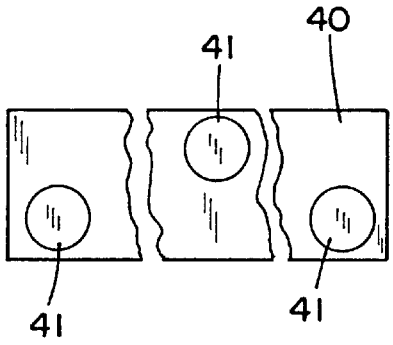
FIG. 7 illustrates the arrangement of fastener elements for the sensor carrier.

The FIGS. 6 and 7 illustrate the fastening possibility of the sensors 32 or, respectively, 11 to the rails 27. This fastening system can be mounted between two neighboring crossties of a track. An L-shaped carrier element 36 is fastened in form-fittingly to the inner side 37 of the rail base 38. A threaded rod 39, which extends through the vertical arm 40 of the carrier 36 is turned in up to a stop and prevents that the carrier 36 can again loosen itself from the rail 27. The threaded rod 41 is equipped with a plurality of elongate apertures 42 which are configured in such a manner that the threaded rod 41 can be secured against unauthorized outward rotation; for example, by means of a hanging lock. For this purpose, the hanging lock is suspended in the elongated aperture between the rail 27 and the arm 40 of the carrier 36, which is the closest to the threaded bore in the arm 40. Fastened the carrier 36 are the required sensors at location 43.

This proposed solution has the advantages that by means thereof a sensor can be rapidly mounted, and there is prevented an unauthorized removal of the sensor, the loosening of the fastening installation through vibration is impossible due to the form fitted structure, and its sensor can be mounted without further adjusting work on different rail profiles.

Furthermore, the sensor unit 2 in FIG. 1 possesses an energy supply in the form of batteries, or an accumulator 14 for a continuous operation of 24 hours, as well as thermal batteries 15 for the display/report of discharged batteries/accumulators. A switch 16 for the actuation of the sensor unit 2 is located either externally or, for improved safety against either desired or undesired erroneous operation, in the interior of the sensor unit 2. In the event of the interior arrangement of the switch 16, the latter is activated from the outside through an electronic auxiliary apparatus. A test installation 17 for a testing of the operative readiness of the system emits a warning signal upon actuation and switching-off.

The sensor unit 2 transmits the amplified measured signals to the evaluating unit/central unit 4. The latter forms the median value from the measurement signals of all three coordinate directions, and computes the gradients of this effective value. The evaluating unit 4 operates thereby in a three-channel system. The gradient consideration of the measured effective value is consequently to be selected in such a manner, that the early warning system will also function when there are installed in the measuring range of the sensor 11 vibration-emitting work systems. In order to trigger an alarm, the actual measured signal must assume a higher value than a defined threshold value, and a higher value than the signal of the last measurement pulse so that the shocks which emanate from a permanent source can be blended out. Upon the deactivation of the system, the evaluating unit 4 emits a characteristic hupping tone. The batteries or accumulator 18 serve for an energy supply for a 24-hour continuous operation, and thermal batteries 19 for the display/report of discharged batteries/accumulator.

The above-described gradient consideration is one of a plurality of possible ways of which are presently preferred by the invention, since they are implementable extremely simply and efficiently. Eventually, a support may also be necessary through other methods under special requirements.

The evaluating unit or, respectively, central unit 4 delivers the command for the transmission of a "yes" or a "no" signal to the transmitting unit 5, which then transmits the applicable signal further to different receivers. The transmitting unit 5 also possesses batteries or accumulators 20 for an energy supply for 24 hour continuous operation, and thermal batteries 21 for the display/report of discharged batteries/accumulators.

The evaluating unit 4 additionally transmits an activating signal to the protocol unit 7. In the protocol unit 7 there are the protocolled the activation and deactivation of the system, as well as individual alarms with clock time and date. In the protocol head there are retained the building site, date, time interval, responsibility and location.

The receiver 22 on the compressed air bottle (siren) 8 receives a signal from the transmitting unit 5 and in case of the "yes" signal, activates through a compressed air valve 23 the periphery apparatus siren or claxon 8. A manual servicing of the siren 8 ahead of the location is at all times additionally possible.

A further signal from the transmitting unit 5 is transmitted to the receivers of the individual workers, and which are carried on the body 9 of the persons. These receivers 9 are carried, for example, on the seat or hip region which is sensitive to vibrations, and in the case of the "yes" signal, warn by means of vibration of predeterminal intensity and duration. Additionally, in the receiver 9 there can also be generated an optical excitation; for example, a flash or a plurality of flashing lights at predetermined intervals and predetermined overall duration, and/or an acoustic signal. Between two alarms there is no dead period for the receiver. The receiver on the body 9 possesses an energy storage 24 with a rapid charge and full charge function.

Figure 8:
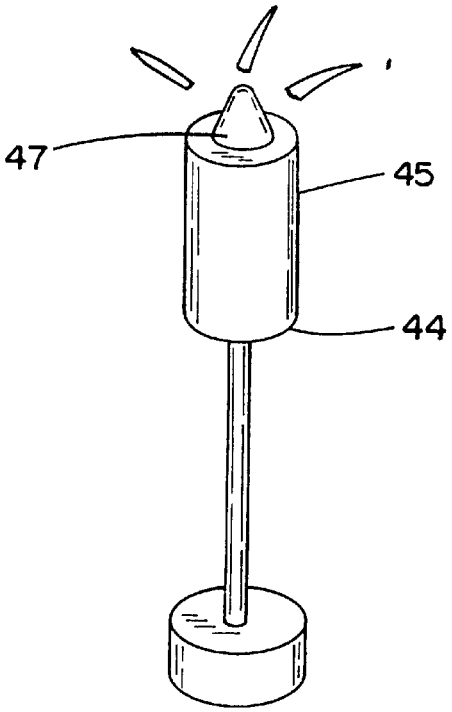
FIG. 8 illustrates an optical alarm installation with the alarm in Stage I.
Figure 9:
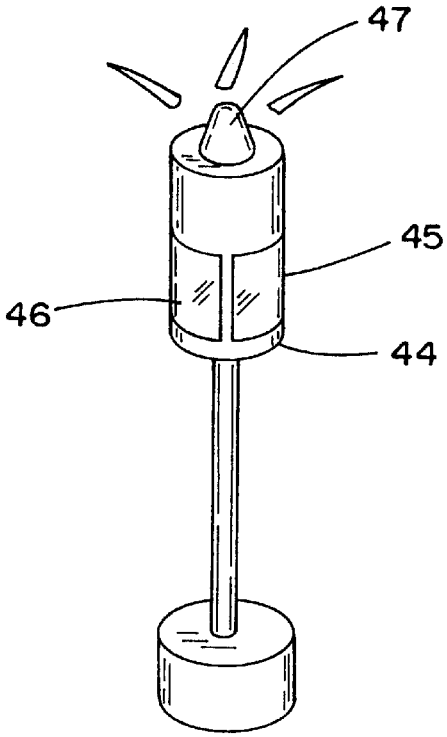
FIG. 9 illustrates the optical alarm installation with the alarm in Stage II.

A particular optical warning signal device is illustrated in FIGS. 8 and 9. Warning signals at track construction sites, which signal an approaching train, must indicate the actual warning stage to the track workers up to a definite resetting command. Hereby, this can relate to one or more warning stages. The example in FIGS. 8 and 9 includes a 2-stage warning signal installation.

This 2-stage warning signal installation 44 consists of a preferably round cylinder 45 with a movable shutter. This shutter releases a glass cylinder 46. On the cylinder 45 there is located a flashing-light lamp 47 which is switched on when a train approaches. This approach of a train represents the alarm stage I and requires the interruption of the work in the track zone, and for observation of the train traveling therepast.

The observer next sees at each point in time a black cylinder 45 below the flashing-light lamp 47. When this shutter is now opened, which signifies the warning stage II and requires the immediate clearing of the track zone, then during the day, daylight passes through the glass cylinder 46. During the night there is activated a light which is inserted into the glass cylinder. In both instances, the observer recognizes a cylinder as a black line which is interrupted by light. Such an indicator is consequently usable during the day and night, and its signaling is ascertainable from all sides; the recognition of the warning is under unsuitable optical conditions possibly quite assured, and is adaptable under all conditions of rail operation. Upon a failure of the energy supply, the optical alarm installation 44 basically assumes the highest alarm position.

A resetting signal causes the display 44 to extinguish the flashing light lamp 47, and the shutter is again closed. The display 44 can be controlled manually ahead of the location or through other data transmission technologies; such as radio, cable, infrared or ultrasound conduits which are connected with the central unit.

In an operation of a plurality of transmitting units at one location on the same frequency, care must be taken that through a concurrent transmission, a plurality of transmission units will not "plug together" the receiver, and thereby become inoperative. In contrast with the state of the art, the demand on apparatus is thereby minimized in that from the Physikalisch-Technisches Bundesanstalt in Braunschweig, there are utilized the transmitted time signals (DCF signal). This DCF-signal is utilized in transmitters of the internal clocks running along with the early-warning system for synchronization and for the recognition of the exact beginning of a definite time dial for each participating transmitter. The internal clock which runs along in the transmission unit increases the availability of the system, inasmuch as also in the difficult area of radio technology, a timewise nonreceipt of the DCF-signal will not lead to a system failure.

The beginning of a time dial or cycle of a system can be based at the beginning of a second or minute. In the system of the transmitter there are stored the quantity and the duration of the individual segments of a time dial or cycle, so that there can be oriented a system of different transmitting units on the basis of the stored information through the utilized time dial and on the basis of the known exact time so that there is eliminated an opposite "plugging together" of the transmitters.

Through the utilization of only one type of electronic plate which is controlled in the modular units, such as transmitters, receivers, central unit and the like, which encompass all functions in the form of hardware, there are finally still obtained logistic and safety technique advantages for the early warning system of the invention. Through the integration of all functions in the hardware of the modules, there is avoided any inherently insecure software. The early warning system can be securely constructed from the signal technology. Furthermore, only one module must be developed, tested and serviced, when this technology is of high quality, but nonetheless can be produced inexpensively. Concurrently, the storage and logistic costs for the manufacturer and for the user are lowered.

We claim:

1. Method for sensing a source of danger, especially an early warning system for detecting of approaching railway vehicles through sensors or through safety posts, and for emitting warning signals to persons or groups of persons present in a danger zone, whereby the warning signal are selectively amplified and transmitted to an alarm arrangement, characterized in that, the source of danger is detected through acoustic and/or optical and/or electronic sensors (11) and/or through a manual input, which signals are transmitted further to an acoustic, optical and sensitive alarm arrangement (8, 9, 10), of which at least the sensitive alarm arrangement (9) is carried on the body of the person to be warned, wherein said acoustic sensors (11) pick up a body sound signal triggered directly by the railway vehicle upon traveling over an arrangement at a predetermined location along the rail (3,27); an elastically deformable member (32) being fastened on an inside (31) of the rail (27) which closes off with an upper surface edge of the rail or, respectively, the rail travel surface, and extending in parallel to the rail possess at least one, preferably two successively arranged chambers (35) with a defined, adjustable static pressure, whereby the chamber (35) or, respectively, the chambers (35) are operatively connected with sensors for a signal pickup.

2. Method according to claim 1, characterized that serving as acoustic sensors (11) are vibration receivers which are fastenable to at least one rail (3,27) in a region between two adjacent crossties(12) and which assume body sound vibrations within the range of between 20 Hz to 20 kHz, preferably 12.5 kHz in three coordinate direction, whereby the sensor (11) carries out a gradient consideration of a measured effective value, which sufficiently describes the body sound in the rail (3).

3. Method according to claim 1, characterized in that vibration receivers serve as acoustic sensors (11) which receive a pulse-retaining body sound signal which has entered into the rail (3,27).

4. Method according to claim 3, characterized in that the pulse-retaining body sound signal at the point in time of the traveling over of an arrangement by a railway vehicle at a predetermined location along the rail (3,27) is generated by at least one wheel (26) of the railway vehicle, whereby the arrangement introduces the body sound signal into the rail (3,27) by means of mechanical, hydraulic or pneumatic means.

5. Method according to claim 4, characterized in that a means act on an energy accumulator, spring storage (29), which trigger an entry of the body sound signal into the rail (3,27).

6. Method according to claim 1, characterized that as an optical sensor (11) there is utilized an infrared sensor or a laser beam sensor, which is applicable at least on one rail (3,27) and which detects an object passing the rail (3,27), electronically evaluates the object and upon recognition of the source of danger transmits a signal to the alarm arrangements (8,9,10).

7. Method according to claim 1, characterized in that an ultrasonic-sensor is utilized as the electronic sensor (11), which is applicable at least at one rail (3,27) and which detects an object passing the rail, electronically evaluates the object and upon recognition of the source of danger transmits a signal to the alarm arrangements (8,9,10).

8. Method according to one of claims 1 through 7, characterized that the sensor (11) is fastened by means of a magnet to a side surface of the rail (3,27), preferably a rail web or a rail head.

9. Method according to one of claims 1 through 7, charactered in that the sensor (11) is mechanically connected with the rail and is electronically and/or mechanically secured against unauthorized removal.

10. Method according to claim 9, characterized in that an essentially L-shaped fastening device (36) is attached to an inside of a rail foot (38), through a vertical arm (40) of which there is conducted a threaded rod (41) and turned in up to contacting a stop, whereby the threaded rod (41) is provided with securing means to prevent an outward rotation thereof.

11. Method according to one claims 1 through 10, characterized in that the sensor (11) possesses an operating system switch (16) which is inaccessible from an exterior, and which is actuated through a central unit or other electronic unit electronically and wirelessly.

12. Method according to claim 1, characterized in that a vibrator is utilized as a sensitive alarm arrangement, which exerts on the body of the person to be warned, upon the triggering of a signal, vibrations or, respectively, body oscillations of predetermined duration and magnitude.

13. Method according to claim 12, characterized in that the vibrator is inserted secured against loss in pockets of work clothing, especially in a region of a seat or a hip of the person to be warned.

14. Method according to claim 1, characterized in that as an apparatus utilized as an optical alarm arrangement is a light flashing at predetermined intervals and of predetermined duration, which is optionally carried on the body of the person to be warned.

15. Method according to one of claims 1 or 14, characterized in that the optical alarm arrangement consists of a cylinder (45), in which there is inserted a movable shutter which releases a glass cylinder (46) for through-shining daylight or switched on artificial light, whereby there is provided on or above the cylinder (45) a flashing-light lamp (47) for fulfilling a multi-stage optical alarm signal.

16. Early warning system for sensing of approaching railway vehicles, an electronic evaluation of signals generated in response to said sensing and for an emitting of warning signals to persons or groups of persons located in a danger zone upon recognition of a danger source; including an electronic component plate which is utilizable in a central unit (4) as well as in a transmitting unit (5) and also to the same extent in a receiving unit (7, 8, 9, 10, 12) of the early warning system, which fulfill technologically different requirements of the central unit (4), the transmission unit (5), and the receiving unit (7, 8, 9, 10, 20) of the early warning system and encompasses functions in a form of hardware; including sensors (2, 11, 32) which are constituted of vibration receivers and are adapted to receive a body sound signal which is impulse-retaining and which is triggered along a rail (3), which at the point of time of traveling over an elastically deformable member (32) which is closely connected with a rail upper edge or traveling surface (30), by at least one wheel (26) of a railway vehicle, and through mechanical, hydraulic or pneumatic means of the early warning system is introducible into the rail (3, 27) which acts on an energy storage (29) of the early warning system and which triggers an entry of the body sound signal into the rail (3, 27); including receiving units (7, 8, 9, 10, 22) which encompass acoustic optical and sensitive installations (8, 9, 10) of which the optical alarm installation (10) is a flashing-light device emitting at a predetermined intervals and duration which can be carried on a body of the person to be warned and/or is formed by an apparatus independently positionable separate from the person, the sensitive alarm installation (9) being a vibrator which is permanently insertable in a pocket of an article of work clothing and especially in a hip or seat region of the person to be warned, and upon triggering of a signal exerts vibrations on the body which are, respectively, body vibrations of predetermined duration and magnitude, and including a wireless connection between the central unit (4), the transmitting unit (5) with the sensors (2, 11, 32) and the receiving units (7, 8, 9, 10, 22) with the alarm installations.

17. Early warning system according to claim 16, characterized that each of the vibration receivers (2, 11) is fastenable in a region between two adjacent thresholds (12) fastenable and assumes body sound vibrations of between 20 Hz up to 20 kHz, and preferably 12.5 kHz in three coordinate direction, whereby each said vibration receiver (2, 11) carries out a gradient consideration of a measured effective value which sufficiently describes the impulse retaining body sound in the rail (3, 27).

18. Early warning system according to claim 16, characterized in that the member (32) is fastened to an inner side (31) of the rail (3, 27) and operatively connected in parallel with the rail (27) is at least one chamber (35) with a specified adjustable static pressure, and which is operatively connected with sensors as switches for a signal pick-up.

19. Early warning system according to claim 18, characterized that there provided two successively arranged and separate of said chambers (35).

20. Early warning system according to claim 16, characterized that the sensor (2, 11, 32) with the rail (3, 27) is electronically and/or mechanically secured by a magnet to a side surface of the rail (3, 27) or mechanically connected therewith secured against unauthorized removal.

21. Early warning system according to claim 20, characterized by including an essentially L-shaped fastening installation (36) on an inner side of a rail base (38) by a vertical arm (40) through which there is passed a threaded rod (41) and turned in up to reaching a stop, the threaded rod (41) being provided with securing means for preventing the turning out thereof.

22. Early warning system according to claim 16, characterized in that each vibration receiver (2, 11) for determination of an object passing over the rail (3, 27) has associated therewith an optical sensor with an infrared or laster installation.

23. Early warning system according to claim 16, characterized in that the vibration receiver (2, 11) for determination of an object passing over the rail (3, 27) has an electronic sensor associated therewith.

24. Early warning system according to claim 16, characterized in that the sensor (2, 11) possesses an operating system switch (16) which is inaccessible from an exterior, and which is wirelessly actuatable by an electronic unit.

25. Early warning system according to claim 16, characterized in that the optical alarm installation is constituted of a cylinder (45) in which there is inserted a movable shutter which releases a glass cylinder (46) for shining through of daylight or of a switched-on artificial light, whereby there is provided on or in a cylinder (45) a flashing-light lamp (47) for fulfilling a multi-stage optical alarm signal.

* * * * *